US005758620A

United States Patent [19]

Warner

[11] Patent Number: 5,758,620

[45] Date of Patent: Jun. 2, 1998

[54] ENGINE COMPRESSION BRAKE SYSTEM

[75] Inventor: Oliver Allen Warner, Brighton, Mich.

[73] Assignee: Detroit Diesel Corporation

[21] Appl. No.: 822,693

[22] Filed: Mar. 21, 1997

[51] Int. Cl.[6] ..... F02D 13/04

[52] U.S. Cl. ..... 123/321

[58] Field of Search ..... 123/321, 322, 123/96.16

[56] References Cited

U.S. PATENT DOCUMENTS

| | | | |
|---|---|---|---|
| 3,220,392 | 11/1965 | Cummins . | |
| 4,150,640 | 4/1979 | Egan . | |
| 4,271,796 | 6/1981 | Sickler et al. . | |
| 4,711,210 | 12/1987 | Reichenbach . | |
| 4,815,424 | 3/1989 | Buuck et al. . | |
| 5,002,022 | 3/1991 | Perr . | |
| 5,033,420 | 7/1991 | Matayoshi et al. . | |
| 5,036,810 | 8/1991 | Meneely . | |
| 5,107,803 | 4/1992 | Furnivall . | |
| 5,152,258 | 10/1992 | D'Alfonso . | |
| 5,163,389 | 11/1992 | Fujikawa et al. . | |
| 5,186,130 | 2/1993 | Melchior . | |
| 5,193,497 | 3/1993 | Hakansson . | |
| 5,195,489 | 3/1993 | Reich . | |
| 5,201,290 | 4/1993 | Hu . | |
| 5,233,951 | 8/1993 | Hausknecht . | |
| 5,273,013 | 12/1993 | Kubis et al. . | |
| 5,315,974 | 5/1994 | Sabelstrom et al. | 123/320 |
| 5,327,858 | 7/1994 | Hausknecht . | |
| 5,335,636 | 8/1994 | Bilei et al. . | |
| 5,386,809 | 2/1995 | Reedy et al. . | |
| 5,394,842 | 3/1995 | Kobayashi . | |
| 5,445,116 | 8/1995 | Hara . | |
| 5,460,131 | 10/1995 | Usko . | |
| 5,462,025 | 10/1995 | Israel et al. | 123/321 |
| 5,479,896 | 1/1996 | Freiburg et al. . | |
| 5,511,460 | 4/1996 | Custer . | |
| 5,609,133 | 3/1997 | Hakansson | 123/321 |
| 5,626,116 | 5/1997 | Reedy et al. | 123/321 |

*Primary Examiner*—Raymond A. Nelli
*Attorney, Agent, or Firm*—Bill C. Panagos, Esq.

[57] ABSTRACT

An engine compression brake includes a link piston slidably mounted in a fuel injector or other rocker arm that can extend to cause it's rocker arm motion to be imparted to an associated exhaust rocker arm for achieving a compression brake action. In the retracted position the piston disengages from the exhaust rocker arm so that the engine runs in normal fashion. The piston is supplied with pressurized oil from a pre-existing lubricant line by a three way solenoid valve. This valve diverts oil from the line into a control passage in the rocker shaft that supplies one or more a injector or other rocker arms. The control passage supplies a system of passages, a check valve, and a vent valve in each arm. This valve and passage system supplies oil such that the link piston is extended or retracted. There may also be variable area orifice in the link cylinder to control force build-up, depending in the driving cam characteristics.

13 Claims, 3 Drawing Sheets

ENGINE COMPRESSION BRAKE SYSTEM

BACKGROUND OF THE INVENTION

This invention relates to a compression brake system for an engine, and particularly to a compression brake system having special usefulness in heavy trucks powered by diesel engines.

U.S. Pat. No. 3,220,292, issued to C Cummins on Nov. 30, 1965, discloses a compression brake system for a truck engine, wherein the compression brake augments the conventional truck brake system, thereby protecting the conventional system from excessive wear and potential early failure.

Per the aforementioned patent, the engine can be operated in two modes: power (fueled) and brake (unfueled). When there is no fuel delivered to the engine during a vehicle deceleration, the compression brake system provides a means for opening the exhaust valves of one or more cylinders at conclusion of the compression stroke. Due to the occurrence of compression strokes without subsequent expansion strokes, the engine cylinders absorb the energy supplied by the truck driveline and the engine acts as a vehicle brake. The desired braking power level determines the number of engine cylinders that must be activated in brake mode.

The compression brake systems disclosed in U.S. Pat. No. 3,220,392 generally comprise various supplemental valves, fluid cylinders, and pistons, together with passage systems of a relatively complex character.

The present invention relates to an engine compression brake system that uses a minimum number of add-on components, whereby the system can be manufactured at relatively small additional cost beyond the basic cost of the engine. The system in its preferred embodiment comprises a solenoid valve controlled hydraulic circuit and a link piston mounted in a pre-existing fuel injector rocker arm that imparts motion to a pre-existing exhaust rocker arm. When brake mode operation of the engine is requested, the solenoid valve is actuated. The link piston is hydraulically extended and constrained such that a portion of the normal injector rocker arm motion is transferred to the exhaust rocker arm. This motion is added to the normal exhaust rocker arm cycle. Upon solenoid valve deactivation, the link piston is allowed to retract. The engine returns to power mode where the injector and exhaust rocker arms act independently of each other.

The control system for the link piston comprises one or more solenoid valves and a valve assembly mounted in each injector rocker arm. The valve assembly includes a check valve and a vent valve for the link cylinder. The number of engine cylinders controlled per solenoid determines the incremental brake power control.

Upon activation of the solenoid valve, hydraulic fluid from a pre-existing, pressurized line (engine oil) is supplied to the injector rocker arm valve assembly through passages in the rocker shaft and injector rocker arm. Fluid flows into the link cylinder through the check valve and fully extends the link piston. Additionally, the fluid pressure to the valve assembly closes the link cylinder vent valve.

Upon initiation of the injector rocker arm lift, fluid is trapped in the link cylinder by the check valve and the closed link cylinder vent valve. The link piston is forced to move relative to the injector arm by the motionless exhaust rocker arm. The exhaust rocker arm is held motionless by the exhaust valves that are loaded by the combustion cylinder pressure. Link cylinder pressurization and intra-arm force level is controlled by fluid leakage through a variable orifice that is progressively covered by link piston motion. At the instant the link piston orifice is fully covered, the remaining fluid trapped in the link piston cylinder pressurizes greatly and relative motion between the link piston and injector rocker arm ceases. Further injector rocker arm lift is transferred to the exhaust rocker arm. Near the end of the injector rocker arm cycle, fluid flows through the open solenoid valve and check valve and the link piston fully extends in preparation for the next injector rocker arm cycle.

Upon solenoid valve deactivation, the fluid supply is blocked and the injector rocker arm valve assembly is vented. This causes the link cylinder vent valve to open. A subsequent injector rocker arm cycle causes all fluid in the link cylinder to be exhausted through the link cylinder vent valve. This causes the injector rocker arm to be continuously disconnected from the exhaust rocker arm.

A feature of the invention is that the link piston is controlled by a solenoid valve and a relatively simple system of passages and valving contained in the rocker shaft and fuel injector rocker arm. This minimizes height, weight, and complexity of the system.

THE DRAWINGS

DESCRIPTION OF A PREFERRED EMBODIMENT OF THE INVENTION

Figure 1:
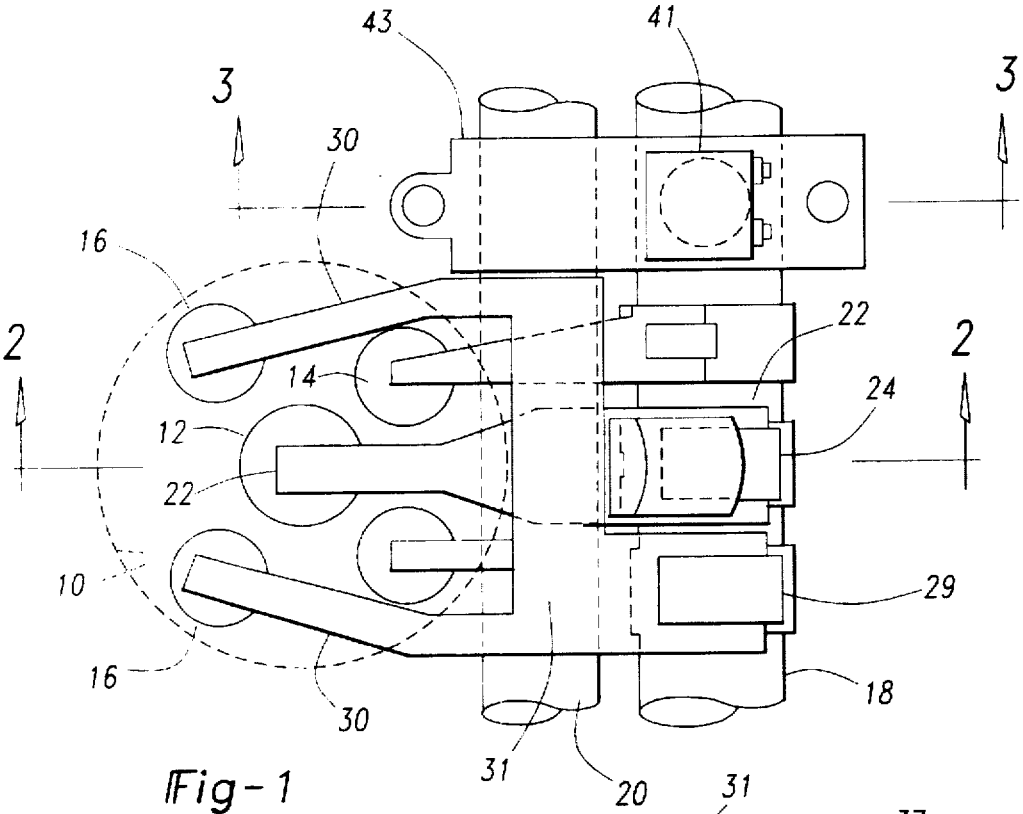
FIG. 1 is a fragmentary top plan view of an engine equipped with a compression braking system according to the present invention.
Figure 2:
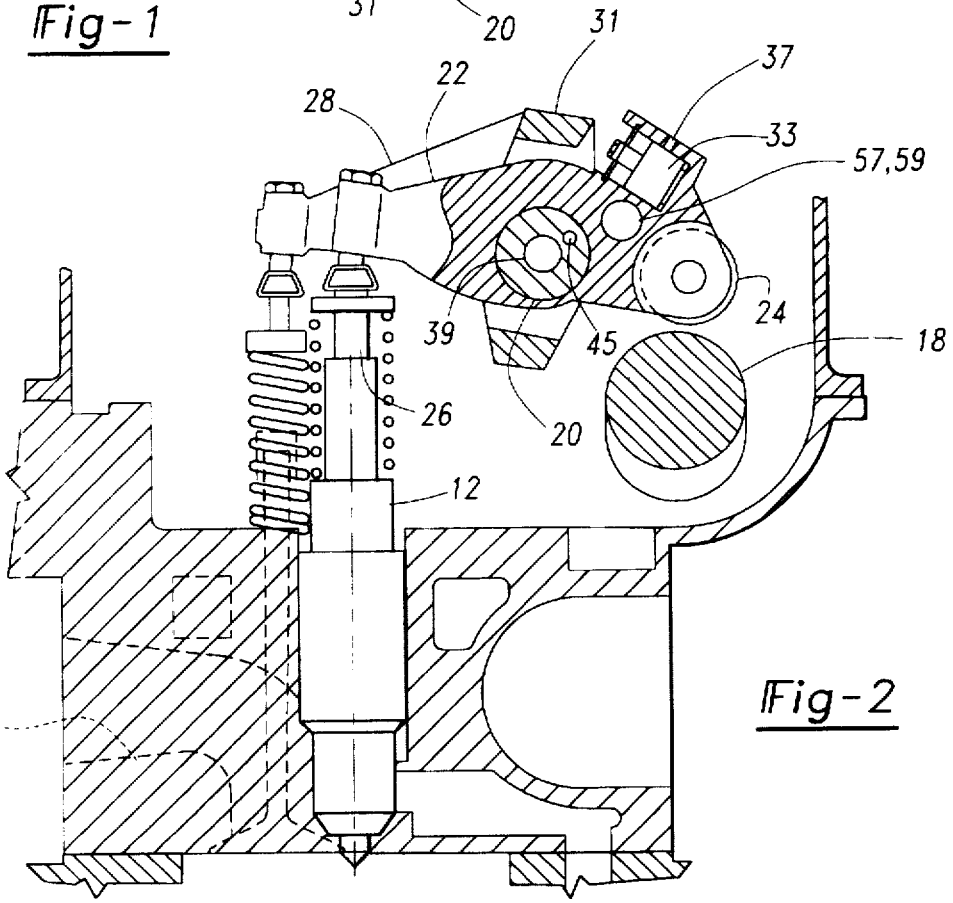
FIG. 2 is a transverse sectional view taken on line 2—2 in FIG. 1.

FIGS. 1 and 2 fragmentarily show a compression ignition engine with one or more combustion cylinders 10. Each cylinder has a fuel injector 12 and its rocker arm 22, two exhaust valves 16 and their rocker arm 28, and two air intake valves 14. A rotary engine-driven cam shaft 18 has cams for operating the overhead rocker arms that actuate the fuel injectors and valves synchronously with the engine cycle. These rocker arms mount on and rotate about a stationary rocker shaft 20 that spans one or more combustion cylinders. The drawings show one representative cylinder; the associated valves, fuel injector, and operating hardware for that cylinder.

FIG. 1 shows the exhaust rocker arm 28 located on rocker shaft 20. Exhaust rocker arm 28 comprises two spaced arm portions 30, 30 connected by bridge 31 with roller 29 which rides on cam shaft 18. As the cam shaft rotates, roller 29 causes rocker arm 28 to swivel about rocker shaft 20 and arm portions 30, 30 causes exhaust valves 16, 16 to move. The fuel injector rocker arm 22 also is located on rocker shaft 20; between exhaust arm portions 30 and below bridge 31.

FIG. 2 shows the fuel injector rocker arm 22 having a roller 24 riding on the cam shaft 18. As roller 24 rides on rotating cam shaft 18, injector rocker arm 22 swivels about rocker shaft 20 and the injector plunger 26 is moved.

The invention is concerned with causing compression brake operation of a engine cylinder by means of a link piston 33 slidably mounted in a cylinder 35 incorporated in fuel injector rocker arm 22. Piston 33 is slidable on its axis between a retracted position, shown in FIGS. 2 and 4, and an extended position shown in FIG. 6. When piston 33 is in its retracted position (FIGS. 2 and 4) the cylinder is in the normal power mode; piston 33 is fully disengaged from bridge 31. When piston 33 is in its extended position (FIG. 6) that engine cylinder is in the brake mode.

Figure 6:
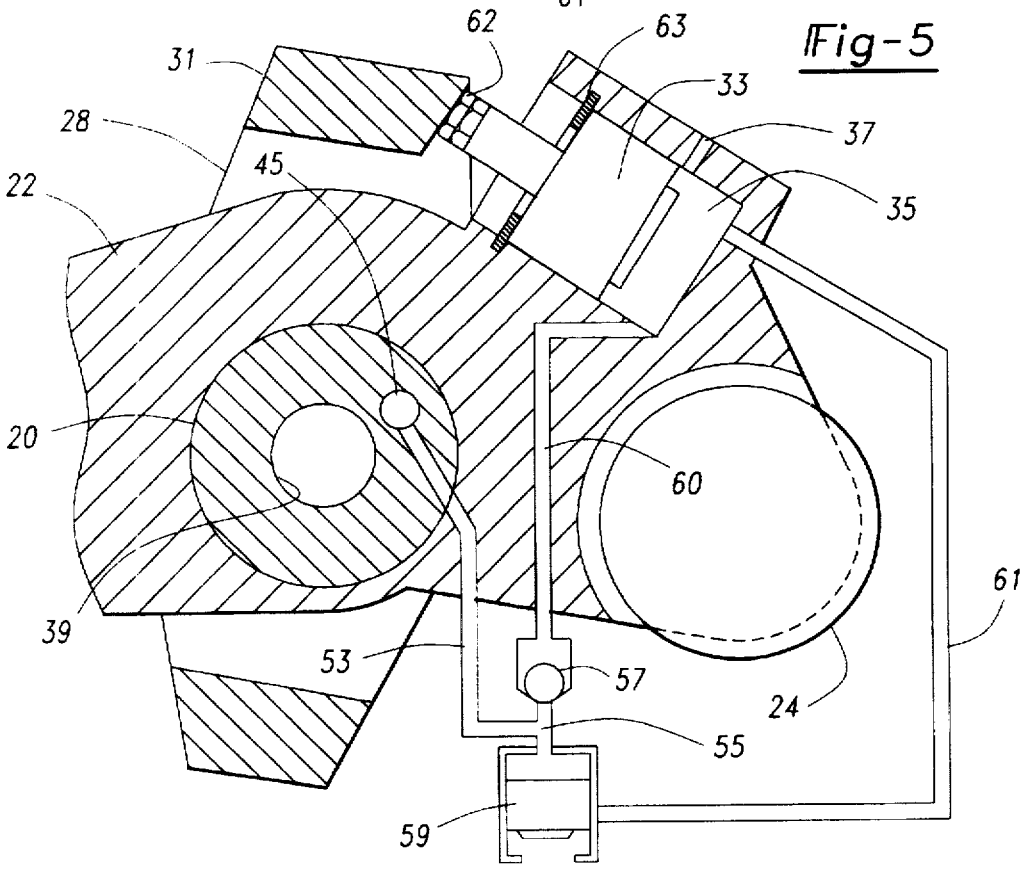
FIG. 6 is a view taken in the same direction as FIG. 4, but with the link piston in an extended operating position adapted to impart motion to an associated exhaust rocker arm.

FIG. 6 shows the fuel injector rocker arm 22 prior to being rotated counter-clockwise by the cam shaft; hydraulic fluid flows into link cylinder 35 and piston 33 extends until encountering stop 63. As rocker arm 22 rotates in a counter-clockwise direction around rocker shaft 20, adjusting screw 62 (attached to piston 33) engages wall 31 on the exhaust rocker arm 28 while the cam 18 velocity (and consequent impact load) is relatively low. As further rotation of the injector rocker arm occurs, piston 33 retracts into the cylinder and force increases between piston 33 and the motionless wall 31. The rate of force build-up is controlled by a decreasing fluid discharge through variable orifice 37 which is closed by the retraction of piston 33. Upon full closure of variable orifice 37, the piston acts as a rigid extension of rocker arm 22; thus imparting motion to the exhaust rocker arm 28. Exhaust valves 16, 16 are forced to open; thus permitting the compressed air in cylinder 10 to be exhausted into the exhaust passage 17 (FIG. 2).

During this described motion of piston 33 and rocker arms 22 & 28, injector 12 must not inject fuel. The described motion of piston 33 occurs at the end of the compression stroke, i.e. during the time period when fuel would ordinarily be injected into the engine. The precise instant that the rocker arm 22 moves arm 28 is controlled by adjustment of screw 62. This determines the injector camshaft lift at which variable orifice 37 is closed by piston 33. During normal operation of the engine, piston 33 is retracted to the position of FIGS. 2 and 4; the piston is continually disengaged from arm 28 when the engine is in the normal run mode.

The electro-hydraulic control system for enabling and disabling the compression brake function (by means of extension and retraction of link piston 33) depends solely on whether solenoid 41 is activated or not.

Figure 3:
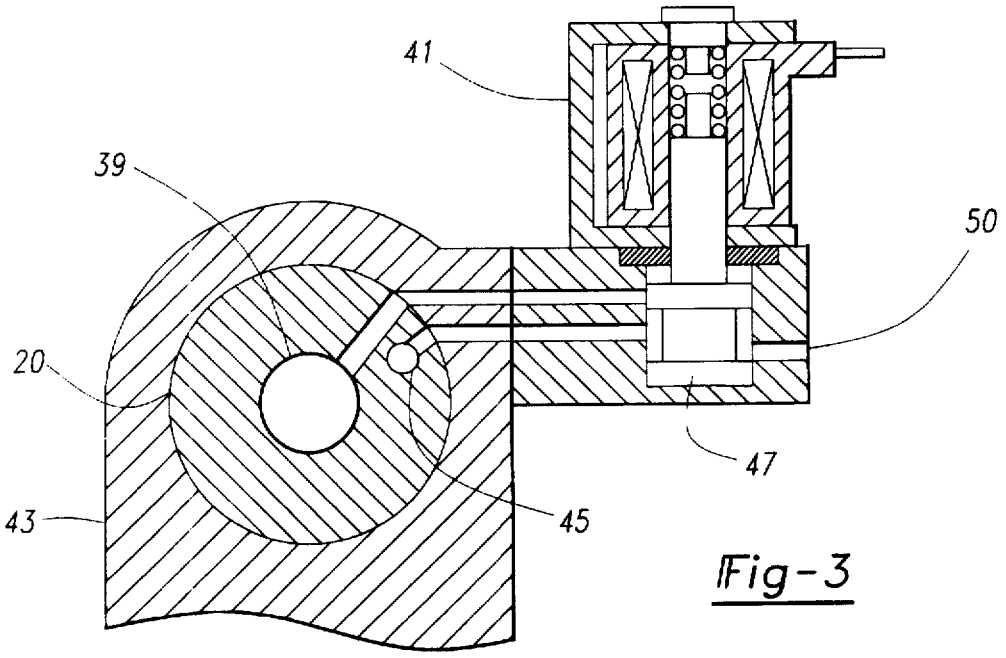
FIG. 3 is a fragmentary sectional view taken on line 3—3 in FIG. 1.

As shown in FIG. 3, a solenoid valve comprising a solenoid 41 and spool valve 47 is mounted on a support structure 43 for rocker shaft 20. This controls fluid supply from a pre-existing continuously pressurized lubricant line 39 into control passage 45. With appropriate passage configurations, the solenoid valve may be mounted in other locations. Depending on the number of injector rocker arms interconnected by control passage 45, one solenoid valve can cause one or more cylinders to operate in brake mode depending on the desired level of control over engine brake power.

The solenoid valve uses a three way spool valve 47. In its deactivated state (as shown in FIG. 3), the upper land closes passage 48 leading from passage 39 and the lower land opens vent port 50 allowing control passage 45 to drain by means of passage 51. When electrical current is supplied solenoid 41, spool 47 moves to block vent port 50 by means of the lower land and passage 48 is uncovered thus allowing fluid to flow from passage 39 to passage 45.

Figure 4:
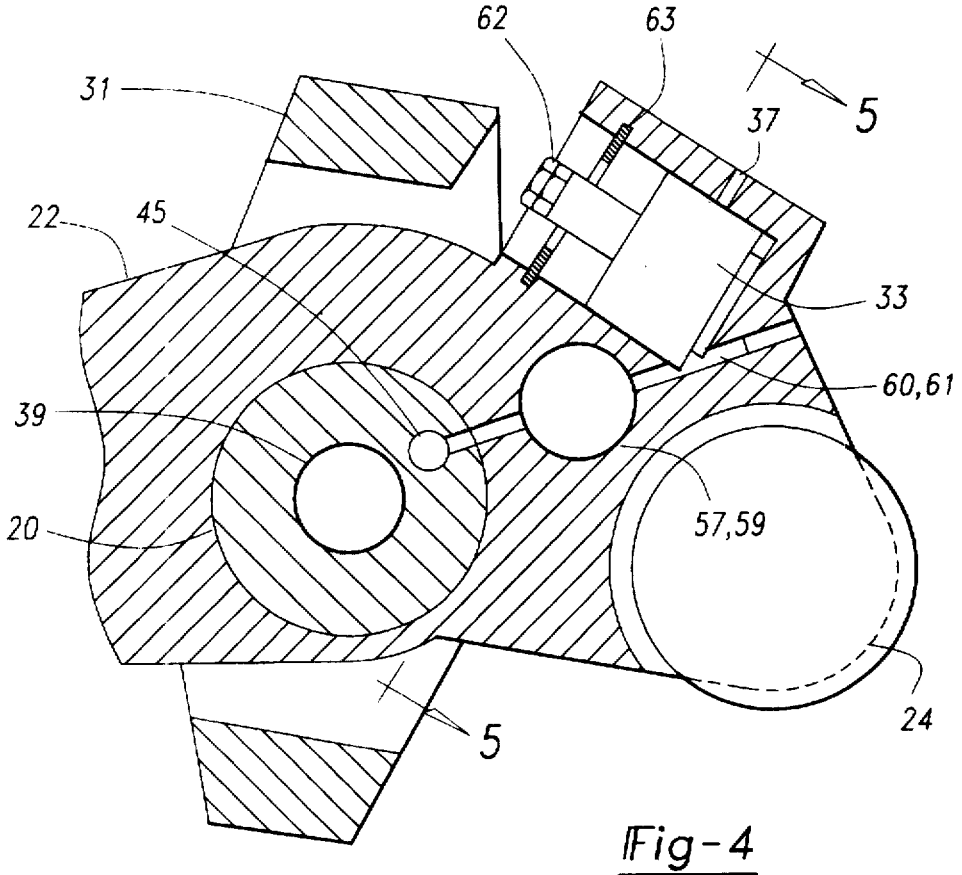
FIG. 4 is an enlarged fragmentary sectional view taken in the same direction as FIG. 2, but showing some features not apparent in FIG. 2.
Figure 5:
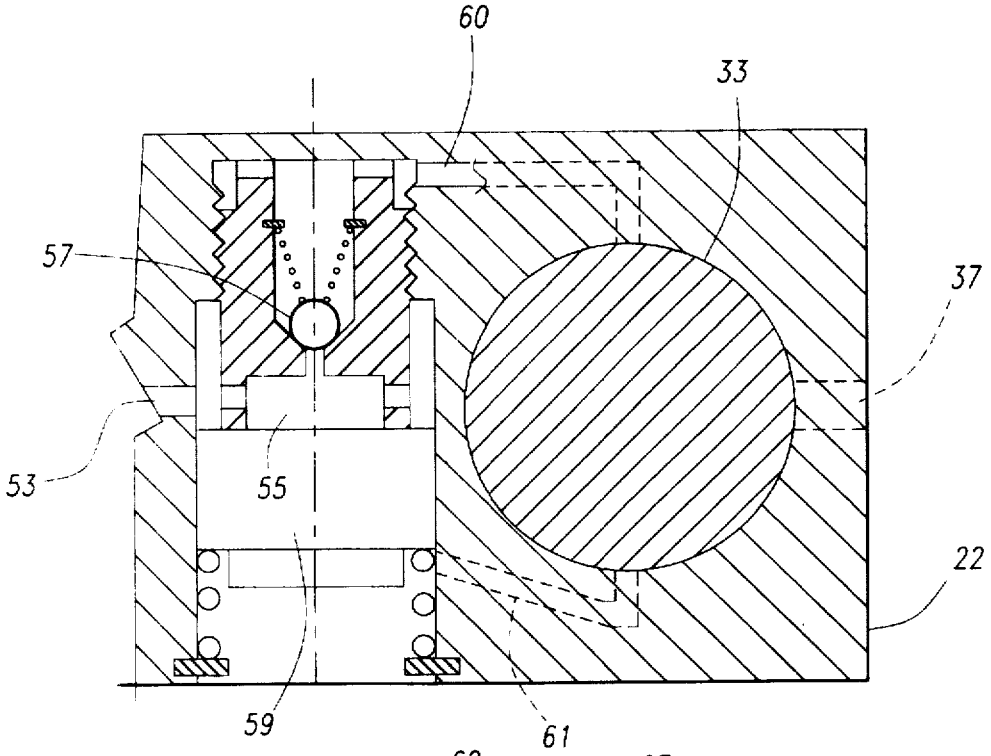
FIG. 5 is a fragmentary sectional view taken on line 5—5 in FIG. 4.

FIGS. 4 through 6 illustrate a passage system in fuel injector rocker arm 22 leading to and from the link cylinder 35. Passage 53 leads from control passage 45 to a chamber 55 that communicates with a check valve 57 and an end surface of a vent valve plunger 59. When chamber 55 is pressurized by solenoid activation, fluid can flow through the check valve into the link cylinder 35 by means of passage 60 at times depending on pressure differential across the check valve. Also, the vent valve plunger 59 is moved slideably from the FIG. 5 position to close passage 61 connected to link cylinder 35. Upon solenoid deactivation, chamber 55 is depressurized and the check valve 57 and vent valve plunger 59 assume the positions depicted in FIG. 5. This allows link piston 33 to completely retract into cylinder 35 during a subsequent injector rocker arm cycle. Fluid is displaced out of cylinder 35 through open passage 61 as piston 33 is pushed by motionless exhaust rocker arm 28.

By way of summarization, during normal operation of the engine the solenoid (FIG. 3) is de-energized; cylinder 35 is depressurized so that piston 33 is in the retracted position (FIGS. 2 and 4). Upon cessation of fuel injection by injector 12, solenoid 41 is activated and spool valve 47 is lifted to a position wherein oil is diverted from pressurized line 39 into control passage 45 (via passages 48 and 51). Oil flows into cylinder 35 through one way check valve 57. Piston 33 is thereby moved to the FIG. 6 extended position.

Near the end of each compression stroke the fuel injector rocker arm 22 moves counter-clockwise so that piston 33 imparts motion to the exhaust rocker arm 28; this action causes exhaust valves 16 to open, for exhausting the compressed air out of cylinder 10. When piston 33 initially contacts wall 31 of the exhaust rocker arm, some oil is vented out of cylinder 35 through variable orifice 37, until the side surface of piston 33 closes orifice 37; thereafter piston 33 acts as a rigid extension of rocker arm 22. The vent action of orifice 37 minimizes shock forces that might otherwise be generated between piston 33 and wall 31.

The illustrated arrangement is a relatively low cost mechanism for achieving the desired compression brake function. The control mechanisms are housed, to a great extent, in injector rocker arm 22. The system is relatively compact so as to add very little to the overall height of the engine. Also, the various oil passages are internal to pre-existing parts, not separate tubes or conduits. The hydraulics use engine gallery oil and does not require an additional, external source of high pressure.

DESCRIPTION OF OTHER EMBODIMENTS OF THE INVENTION

Compression ignition engines may utilize an injection system where there is no injector 12 actuated by injector rocker arm 22 and its camshaft lobe. A variation of the system described by this patent can be utilized to achieve the compression brake function for these kinds of engines as follows.

The modified system comprises a half rocker arm caused to follow the cam by means of some spring arrangement and a cam lobe specifically designed for opening exhaust valves at the end of the compression stroke. These elements would replace the injector rocker arm 22 and its cam with no change to the intake and exhaust rocker arms. The half rocker arm would contain the link piston cylinder, passages, and valve assembly exactly as described herein. However, since the cam opens the exhaust valves without the high velocities associated with the injector cam, the variable area orifice 37 can be eliminated. The solenoid valve and the hydraulic control system remains the same as described herein.

What is claimed is:

1. A compression brake system for an engine wherein said engine includes a rocker shaft, an exhaust rocker arm on said rocker shaft, and a fuel injector rocker arm on said rocker shaft; said compression brake system comprising a hydraulically controlled link piston in a cylinder on said injector rocker arm slidable between a first extended position where it is capable of imparting motion from said injector rocker arm to said exhaust rocker arm and a second retracted position fully disengaging said injector rocker arm from said exhaust rocker arm.

2. The compression brake system of claim 1, and further comprising means for supplying hydraulic fluid to said link cylinder, said fluid supply means comprising a control passage in said rocker shaft.

3. The compression brake system of claim 1, wherein said fluid supply means further comprises a solenoid valve controlling flow through said control passage in the rocker shaft.

4. The compression brake system of claim 1, and further comprising means for supplying hydraulic fluid to said link cylinder; said fluid supply means comprising a continually pressurized lubricant line, a control passage in said rocker shaft normally disconnected from said pressurized line, and a solenoid valve controlling flow of fluid from said line into said passage.

5. The compression brake system of claim 4, wherein said solenoid valve comprises a first port directly connected to said pressurized line, a second port directly connected to said control passage, and a third vent port.

6. The compression brake system of claim 5, wherein said solenoid valve comprises a spool valve movable between a first position (deactivated state) wherein said second port is connected to said third vent port thus causing a relatively high pressure in the said control passage, and a second position (activated state) wherein said second port is connected to said first port thus causing a relatively low pressure in the said control passage.

7. The compression brake system of claim 4, and further comprising a control means in said injector rocker arm for controlling fluid supply to said link cylinder; said control means comprising a check valve permitting fluid flow from said control passage to said link cylinder, and a vent valve that allows fluid escape from said link cylinder all of which depend on the state of said solenoid valve.

8. The compression brake system of claim 7, wherein said vent valve comprises a compression spring and a slidable plunger whose position is controlled by the pressure prevailing in said control passage.

9. The compression brake system of claim 7, wherein said vent valve comprises a slidable plunger and a passage connecting the link cylinder and a side surface of the plunger; said plunger having an end surface in fluid communication with said control passage, whereby said plunger closes said connecting passage when the pressure in said control passage is relatively high and opens said connecting passage when the pressure in said control passage is relatively low.

10. The compression brake system of claim 1, and further comprising a means to control force build-up by said link piston, whereby said piston experiences initial movement toward the retracted condition in response to the motionless exhaust rocker arm that is constrained by cylinder pressure acting on the exhaust valves.

11. The compression brake system of claim 10, wherein said means for controlling force build-up comprises a optional variable area orifice communicating with a side surface of said link piston, whereby said vent port is closed by the piston as said piston moves from its extended position toward its retracted position thus allowing fluid to escape from said link cylinder at a decreasing rate such that pressure increases.

12. The compression brake system of claim 11, wherein the instant of closure for said variable area orifice may be adjusted by means of a screw attached to said link piston.

13. A compression brake system for an engine wherein said engine includes a rocker shaft, an exhaust rocker arm on said rocker shaft, and a fuel injector rocker arm on said rocker shaft; said compression brake system comprising a hydraulically operated piston in a link cylinder on said injector rocker arm movable between a first extended position to impart motion to said exhaust rocker arm and a second retracted position continually disengaged from said exhaust rocker arm; a source of pressurized hydraulic fluid for said piston; and means for controlling the flow of hydraulic fluid to and from the link cylinder; said fluid source comprising a continually pressurized lubricant line, a control passage in said rocker shaft normally disconnected from said pressurized line, and a solenoid valve controlling flow of fluid from said line into said passage; said control means comprising a check valve in said injector rocker arm permitting one way flow of fluid to said cylinder causing full piston extension, and a vent valve comprised of a plunger and compression spring controlling full piston retraction by the escape of fluid from said link cylinder; a variable area orifice in the link cylinder wall that is closed during initial motion of the link piston thus controlling force buildup between said injector rocker arm and said exhaust rocker arm.

* * * * *